US009050607B2

(12) United States Patent
Heley et al.

(10) Patent No.: US 9,050,607 B2
(45) Date of Patent: Jun. 9, 2015

(54) DECANTING CENTRIFUGE WITH PLURAL SCREEN SUPPORT SECTIONS

(75) Inventors: Trevor Heley, Huddersfield (GB); John Wright, Huddersfield (GB)

(73) Assignee: Thomas Broadbent & Sons Ltd., Huddersfield (GB)

( * ) Notice: Subject to any disclaimer, the term of this patent is extended or adjusted under 35 U.S.C. 154(b) by 859 days.

(21) Appl. No.: 13/141,980

(22) PCT Filed: Dec. 22, 2009

(86) PCT No.: PCT/GB2009/051759

§ 371 (c)(1),
(2), (4) Date: Sep. 13, 2011

(87) PCT Pub. No.: WO2010/073037

PCT Pub. Date: Jul. 1, 2010

(65) Prior Publication Data

US 2011/0315621 A1 Dec. 29, 2011

(30) Foreign Application Priority Data

Dec. 23, 2008 (GB) ..... 0823427.0

(51) Int. Cl.
*B04B 3/04* (2006.01)
*B04B 7/16* (2006.01)

(52) U.S. Cl.
CPC .... *B04B 3/04* (2013.01); *B04B 7/16* (2013.01)

(58) Field of Classification Search
CPC ..... B04B 3/04; B04B 7/16
USPC ..... 210/360.1, 369, 372, 374, 380.1
See application file for complete search history.

(56) References Cited

U.S. PATENT DOCUMENTS

| | | | | |
|---|---|---|---|---|
| 1,478,660 A | | 12/1923 | Barnes et al. | |
| 3,401,800 A | * | 9/1968 | Stock | 210/380.3 |
| 3,957,652 A | * | 5/1976 | McGonigal | 210/498 |

FOREIGN PATENT DOCUMENTS

| | | | |
|---|---|---|---|
| DE | 3102303 | A1 | 8/1982 |
| GB | 550876 | A | 1/1943 |
| WO | 2010073037 | A1 | 7/2010 |

OTHER PUBLICATIONS

International Search Report and Written Opinion dated Mar. 1, 2010 for International Application No. PCT/GB2009/051759 from European Patent Office, filed Dec. 22, 2009, pp. 1-12, Rijswijk, Netherlands.

International Search Report and Written Opinion dated Mar. 25, 2010 for International PCT Application No. PCT/GB2009/051759 from European Patent Office, pp. 1-12, Rijswijk, Netherlands.

* cited by examiner

*Primary Examiner* — Fred Prince
(74) *Attorney, Agent, or Firm* — Sherman IP LLP; Kenneth L. Sherman; Hemavathy Perumal

(57) ABSTRACT

A screen bowl decanting centrifuge comprising a rotatable bowl (4) and a conveyor assembly (8) adapted, in use, to separate a slurry into solids and liquids components, and an outlet for the liquids component which outlet communicates with the inlet (102) of a perforated bowl section (100) arranged, in use, to filter the liquids component as it passes through the perforations of a screen or screens (13), wherein the perforated bowl section (100) comprises a plurality of removably mounted screen support sections (50).

15 Claims, 8 Drawing Sheets

DECANTING CENTRIFUGE WITH PLURAL SCREEN SUPPORT SECTIONS

CROSS REFERENCE TO RELATED APPLICATIONS

This application is the U.S. National Phase Patent Application under 35 U.S.C. §371 of International Application No. PCT/GB2009/051759 (published as WO 2010/073037), filed Dec. 22, 2009, which claims priority to United Kingdom Patent Application No. GB 0823427.0, filed in the United Kingdom Patent Office on Dec. 23, 2008. Both applications, PCT/GB2009/051759 and GB 0823427.0, are incorporated herein by reference in their entirety.

This invention relates to improvements in and relating to screen filters, and in particular, but without limitation to, screen filters for screen bowl decanting centrifuges. This invention also relates to improvements in the overall operating efficiency of screen bowl decanting centrifuges, particularly, but not exclusively, to those used for processing abrasive slurries.

Decanting centrifuges employ a cylindrical/conoidal bowl and a helical scrolled conveyor assembly to separate a slurry fed thereto into its constituent solids and liquid by sedimentation. The conveyor scrolls the denser solids to discharge ports at the smaller diameter end of the bowl and the separated liquid flows in the opposite direction to ports at the other end of the bowl. The screen bowl decanter has an additional cylindrical (or conoidal) perforated bowl section and a conveyor extension so that, prior to discharge, the solids are scrolled by the conveyor over an additional perforated filter bed or screen section for further separation by filtration.

BRIEF DESCRIPTION OF THE DRAWINGS

Known screen bowl decanting centrifuges are illustrated in FIGS. 1 to 4D of the accompanying drawings in which.

DETAILED DESCRIPTION OF THE INVENTION

Figure 1:
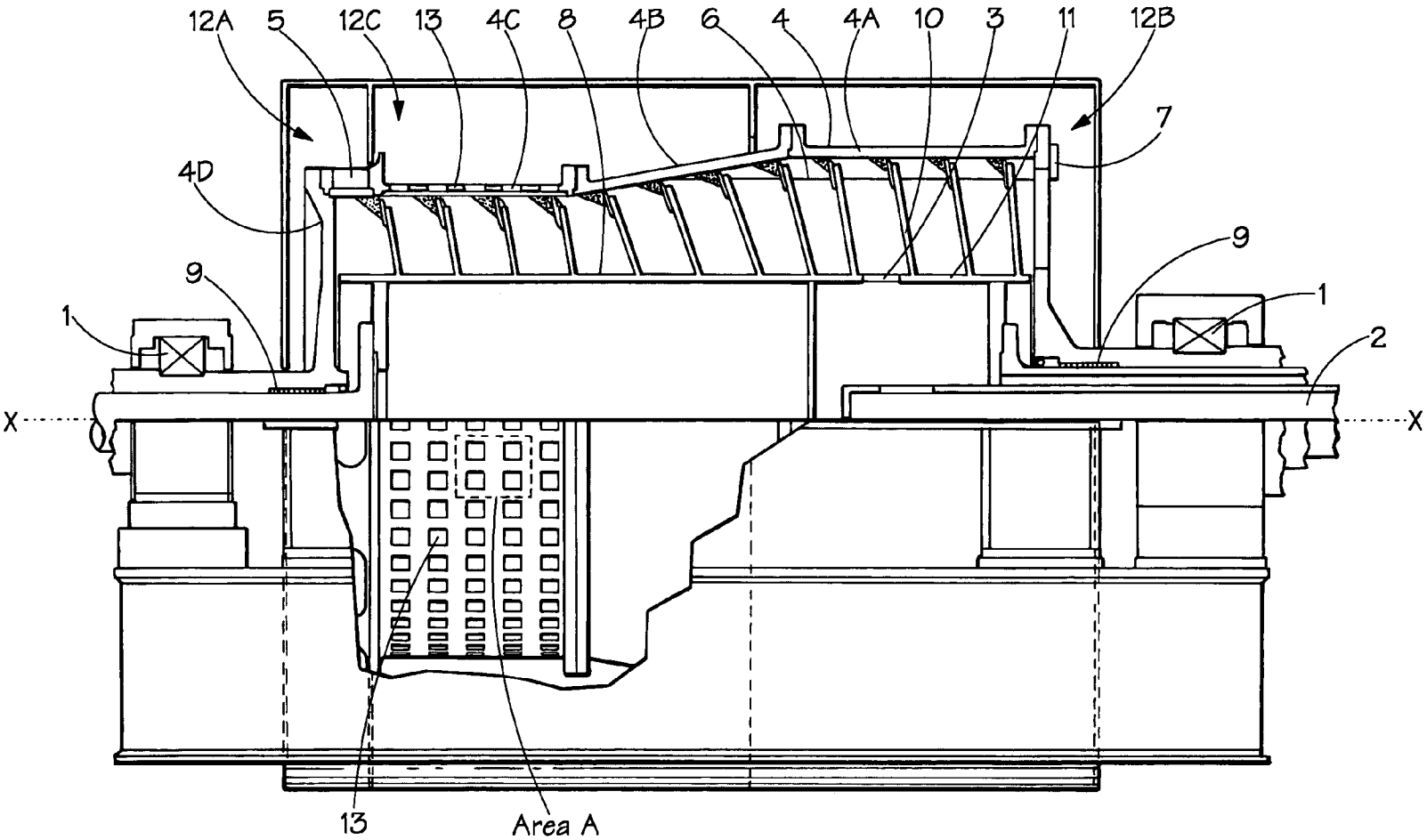
FIG.1. (PRIOR ART)
FIG. 1 is a partial longitudinal cross-section of a known screen bowl decanting centrifuge.

In FIG. 1, a conventional state-of-the-art screen bowl decanter comprises a rotating assembly suspended in bearings 1 and designed to rotate about axis XX. The bearings 1 supporting the rotating assembly are, in turn, supported by pedestals mounted on a base frame and the assembly is rotated by a drive motor (not shown).

To function, a liquid/solids slurry is fed via feed pipe 2 and feed ports 3 into the bowl 4. The bowl is an assembly of a cylindrical section 4A joined to a conoidal-shaped section 4B, to which is joined at the smaller diameter end a cylindrical screen section 4C, providing a perforated filter bed and solids discharge ports 5, and attached in turn to the bowl end plate 4D.

The slurry, subjected to centrifugal force, fills the bowl to the inner liquid surface 6 determined by the radial position of the liquid outlet ports 7 and spills to the casing compartment 12B, which surrounds the bowl. The bowl sections are designed to withstand the stresses induced by the rotation of the bowl and the slurry load contained therein.

A conveyor 8 is coaxially mounted within the bowl 4 and is supported on bearings 9. The conveyor 8 comprises scrolling flights 10 attached to a central hub 11 and wound in a helix closely fitting the bowl inner profile. A gearbox (not shown) drives the conveyor 8 in the same direction of rotation but at a speed slightly different from the bowl 4 such that, relative to the bowl, the flights 10 scroll the separated solids in the opposite direction to the liquid flow. Under centrifugal force, the heavier solids sediment on the bowl wall 4A and are scrolled, by the conveyor flights 10, clear of the liquid surface 6 to the smaller end of the conoidal section 4B and through the screen section 4C to the solids discharge ports 5. The solids are then discharged into the casing compartment 12A.

The lighter liquid, which is separated in the bowl 4 from the decanted solids, flows via the outlet ports 7 into the outer casing 12B. Meanwhile, liquid remaining within the solids in the screen section 4C filters through the solids, under the action of centrifugal force, and passes through the perforations/slots of the screen section and discharges through the holes 13 in the screen section 4C into the outer casing compartment 12C.

FIGS. 2, 3 and 4 show, for the screen inner surface marked area A in FIG. 1, views and cross-sections to describe devices that are typical of the various state-of-the-art devices used to provide an active filtration surface.

Figure 2C:
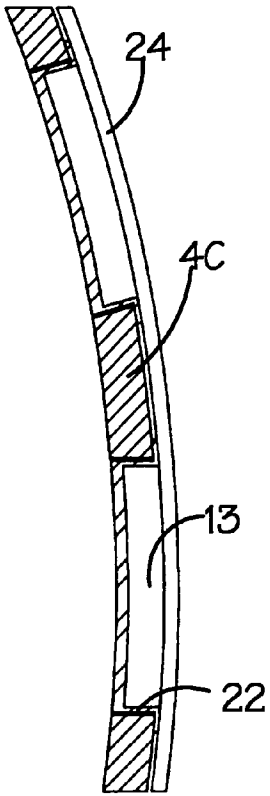
FIG.2C (PRIOR ART)
FIG. 2C is a transverse cross-section of FIG. 2A on 2C2C.
Figure 2B:
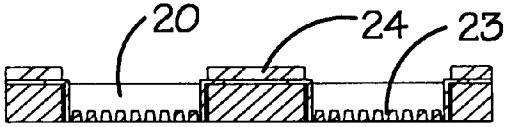
FIG.2B (PRIOR ART)
FIG. 2B is a radial cross-section of FIG. 2A on 2B2B.
Figure 2D:
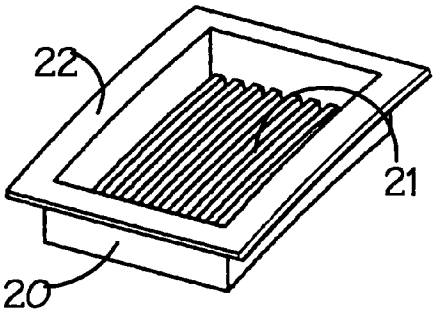
FIG.2D (PRIOR ART)
FIG. 2D is a perspective view of a removable screen filter element as shown in FIGS. 2A, 2B and 2C.
Figure 2A:
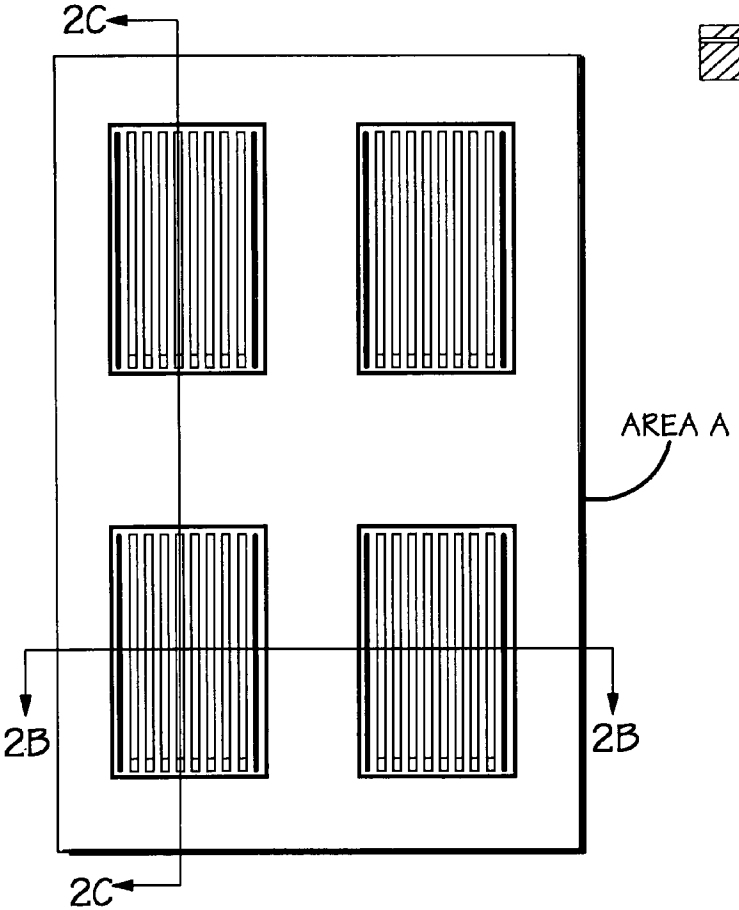
FIG.2A (PRIOR ART)
FIG. 2A is a close-up side view of first embodiment of area A of FIG. 1.

FIG. 2A shows, to a larger scale and within area A, an outward radial view from axis XX of one device in the shape of a series of removable screen elements known as "soap-dishes" 20. FIGS. 2B and 2C show cross-sections of FIG. 2A and FIG. 2D an isometric view of a soap-dish.

Each soap dish 20 comprises a plurality of evenly spaced, parallel bars 21 that are supported within a flanged, rectangular frame 22. The frame is shaped and sized so as to fit into correspondingly shaped and sized through-holes 13 cut into the screen section 4C. The parallel bars 21 are arranged to lie flush with the inner surface of the screen section and form part of the filtration bed. The gaps 23 between the bars are small enough to retain solid particles larger than the gap, whilst providing an open filtration area for the passage of the liquid separated from the slurry. Each soap-dish 20 is held in place by a series of robust, removable circumferential clamp rings 24.

Figure 3C:
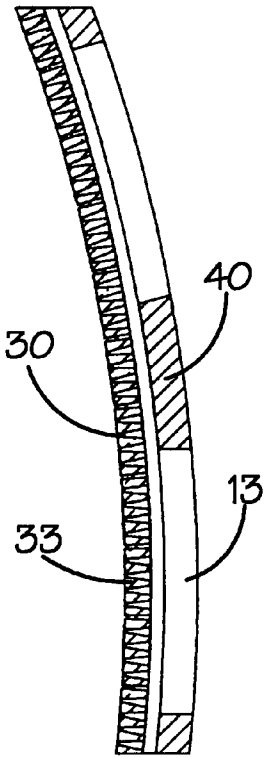
FIG.3C (PRIOR ART)
FIG. 3C is a transverse cross-section of FIG. 3A on 3C3C.
Figure 3B:
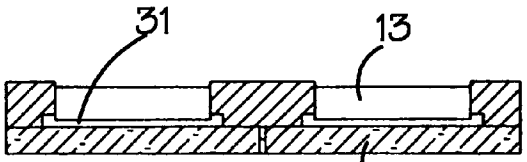
FIG.3B (PRIOR ART)
FIG. 3B is a radial cross-section of FIG. 3A on 3B3B.
Figure 3D:
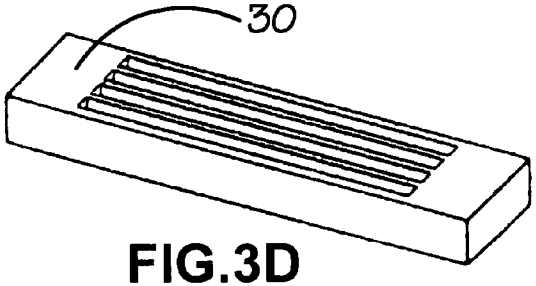
FIG.3D (PRIOR ART)
FIG. 3D is a perspective view of a removable screen filter element as shown in FIGS. 3A, 3B and 3C.
Figure 3A:
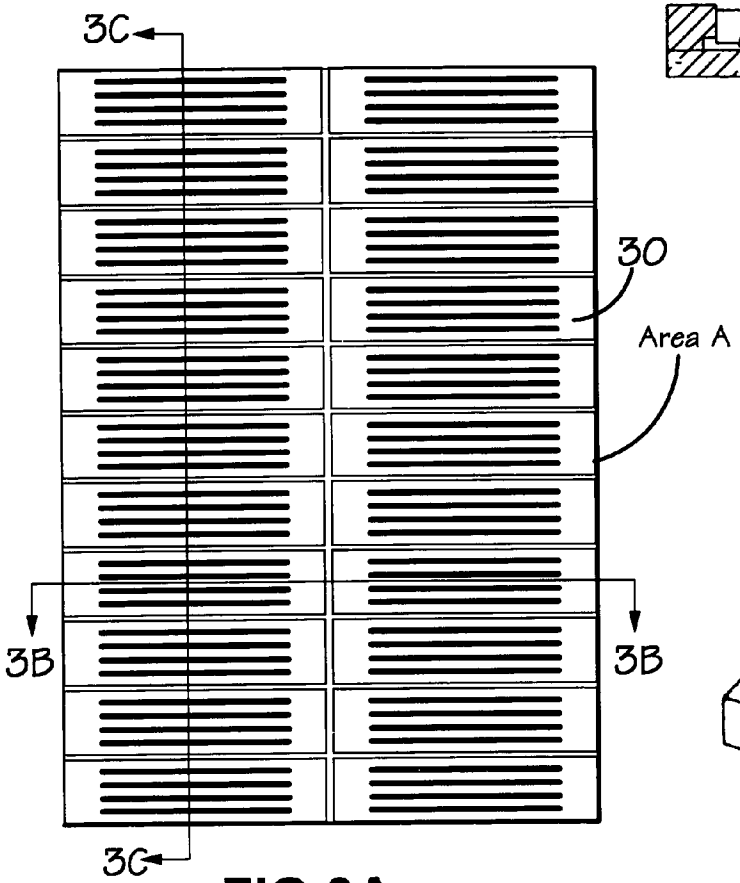
FIG.3A (PRIOR ART)
FIG. 3A is a close-up side view of second embodiment of area A of FIG. 1.

FIG. 3A shows, to a larger scale and within area A, an outward radial view from axis XX of a second known device in the form of slotted filter elements known as "tiles" 30. FIGS. 3B and 3C show cross-sections of FIG. 3A and FIG. 3D an isometric view of a "tile".

The tiles 30 cover the whole inner surface of the screen section 4C shown in FIG. 1. In this construction, the screen cylinder is adapted to support the tiles 30 over the holes 13 and circular grooves 31 cut into the inner surface of the screen cylinder for the flow of liquid into the casing 12C.

Narrow slots 33 in the tiles 30 provide an open filtration area for the passage of the liquid separated under centrifugal forces from the slurry to flow through the circular grooves 31 and holes 13 to discharge. Meanwhile, the remainder of each tile retains solids that are larger than the width of the gaps.

Figure 4C:
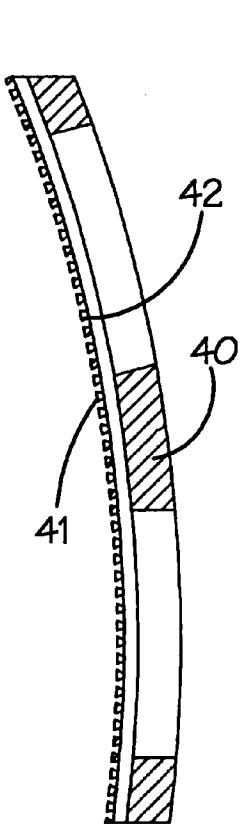
FIG.4C (PRIOR ART)
FIG. 4C is a transverse cross-section of FIG. 4A on 4C4C.
Figure 4B:
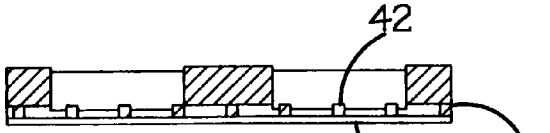
FIG.4B (PRIOR ART)
FIG. 4B is a radial cross-section of FIG. 4A on 4B4B.
Figure 4D:
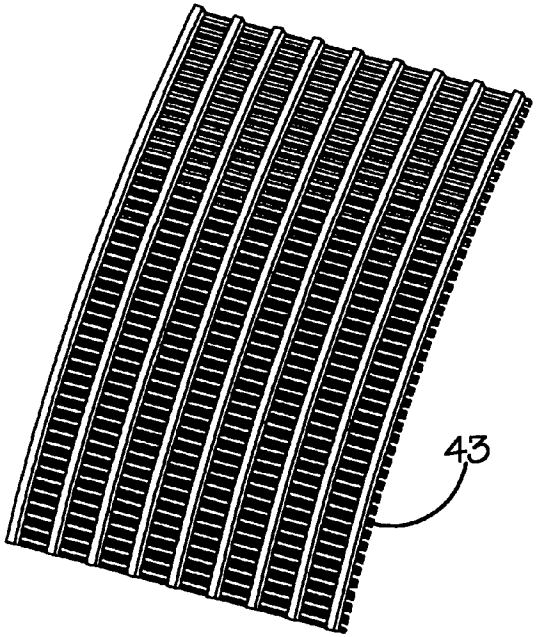
FIG.4D (PRIOR ART)
FIG. 4D is a perspective view of a removable screen filter element as shown in FIGS. 4A, 4B and 4C.
Figure 4A:
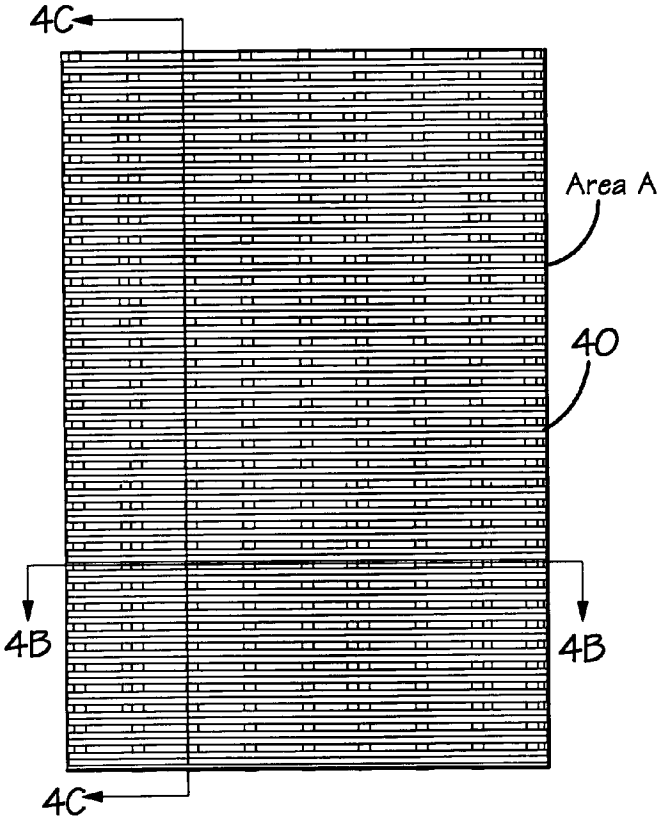
FIG.4A (PRIOR ART)
FIG. 4A is a close-up side view of third embodiment of area A of FIG. 1.

FIG. 4A shows, to a larger scale, and within area A, an outward radial view from axis XX of a third known device in the form of a wire grid. FIGS. 4B and 4C shows cross-sections of FIG. 4A and FIG. 4D an isometric view of a section of the wire grid.

In this example, filtration of liquids from the solids is effected using a continuous wire grid 40 that covers the whole inner surface of the screen section 4C. In this construction, closely spaced parallel wires 41 are attached to, and supported at intervals by, transverse wires 42 that together form a grid. In an analogous manner to that previously described, the narrow gaps 43 between the longitudinal wires retain the solids, whilst the open spaces between the wires provide an open filtration area for the passage of liquid separated from the slurry into the outer casing.

The main drawbacks of the known devices concern the service, repair and replacement of worn-out soap dishes, tiles or grids.

In particular, to service, repair and/or replace the soap dishes of the device illustrated in FIGS. 2A to 2D, one must first remove the top casing 12 and then loosen/remove the clamp rings (of which there are typically 10) so that the individual soap dishes can be removed/replaced. Sometimes it is possible to "cycle" the soap dishes, if they are still serviceable, by moving them to a different location in the screen. Thereafter, the soap dishes need to be re-clamped and the screen reassembled. As there are typically 130 clamped soap dishes to remove/replace, this is often a lengthy and time-consuming process.

To service, repair and/or replace the tiles or wire grids of the devices illustrated in FIGS. 3A to 3D and 4A to 4D, one must first remove the top casing 12 and then remove the drive, feed pipe 2 and bearing pedestal caps so that the entire rotating assembly can be removed from the base frame. The solids discharge end plate 4D must then be un-bolted from the screen and the screen section 4C from bowl section 4B.

In the case of the embodiment illustrated in FIGS. 3A to 3D, the tiles can then be replaced and/or cycled, or a replacement screen section can be fitted. The entire centrifuge must then be reassembled.

In the case of the embodiment illustrated in FIGS. 4A to 4D, the wire grids can then be replaced or reversed, or a replacement screen section can be fitted. The entire centrifuge must then be reassembled.

To service or replace the worn filtration bed on all three devices requires substantial decanter shut down time and labour input—for the tiles and wire grid devices heavy lifting equipment is needed plus the removal of the complete screen section 4C from the rotating assembly 4.

The soap dish and tiles have an inherently low percentage open area (typically between 3.5% and 6%, and between 5% and 8.5%, respectively) as the slots only occupy a small area of the total screen surface. This results in an axially long screen section to achieve the required degree of solids/liquid separation, thereby increasing the overall length and cost of the decanter. Wire grid-type filters typically have a much greater percentage open area, say between 13% and 25%. (The percentage open areas quoted above correspond to slot widths of 0.30 mm for all three devices and estimated over similar areas A.)

An important measure of screen efficiency is the ratio of the total open area divided by the total inner surface area of the screen section expressed as a percentage—the percentage open area. Subjectively, for the given filtration required by the process a low percentage open area requires an axially "long" screen since the screen length is approximately inversely proportional to the percentage open area. This requires a longer and more expensive decanter, and a longer solids residence time on the screen, giving more wear on both the filter bed and the conveyor flights 10 compared to a short screen.

Another important measure of screen efficiency is the maintenance of a close-fitting gap between the scrolling flights 10 and the inner surface of the screen section 4C to ensure maximum solids scrolling to discharge and to avoid a dormant layer of solids on the filter bed, reducing the liquid flow through the filter bed. The conveyor flights 10 will also be subjected to wear, adding to wear on the filtration bed and increasing the close-fitting gap. It is extremely desirable that the conveyor flights 10 be serviced/repaired together with any other worn conveyor components to return the decanter to full operating efficiency. To do this with a known soap dish device requires heavy lifting equipment and the removal of the screen section 4C from the rotating assembly 4.

It is in the construction of the screen cylinder 4C and the various present means of providing the inner perforations or slots, together with the disassembly of the screen cylinder 4C from the rotating assembly for servicing, that this invention offers unique improvements.

According to a first aspect of the invention there is provided a screen bowl decanting centrifuge comprising a rotatable bowl and a conveyor assembly adapted, in use, to separate a slurry into solids and liquids components, and an outlet for the liquids component which outlet communicates with the inlet of a perforated bowl section arranged, in use, to filter the liquids component as it passes through the perforations of a screen or screens, wherein the perforated bowl section comprises a plurality of removably mounted screen support sections.

The inlet of the perforated bowl section may comprise an annular support to which each of the screen support sections is removably mountable. The perforated bowl section may comprise an end plate to which each of the screen support sections is removably mountable.

Each screen support section may comprise a plurality of part-tubular segments that may be individually and/or detachably affixable to, and between, the annular support and the end plate.

The or each part-tubular segment, the annular support and/or the end plate may comprise a flange, and/or each part-tubular segment may be individually and/or detachably affixable to, and between, the annular support and the end plate using screws.

The or each part-tubular segment may comprise a lip or groove adapted, in use, to engage a groove or lip of the annular support or the end plate. The distance between the annular support and the end plate may be adjustable, for example, by using a jacking screw arranged to cooperate with the part-tubular segment and the annular support ring or the end plate for adjusting the spacing between the annular support and the end plate. The jacking screw may be adapted to enable the spacing between the annular support and the end plate to be increased to an extent whereby the lip disengages from the recess.

The or each part-tubular segment may comprise a through aperture or a plurality of through-apertures. A perforated liner may overlie the or each through aperture. The liner, where provided, may be located within the perforated side wall, i.e. located within the interior of the screen bowl. The liner may comprise one or more wire grids and/or one or more soap dishes and/or one or more tiles.

According to a second aspect of the invention, there is provided a screen filter comprising: an annular support; an end plate spaced-apart from the annular support; and a perforated sidewall affixable to, and between, the annular support and end plate.

A third aspect of the invention provides a screen filter for a screen bowl decanting centrifuge as described herein.

A fourth aspect of the invention provides a screen bowl decanting centrifuge comprising a screen filter as described herein.

Two embodiments of the invention shall now be described, by way of example only, with reference to FIGS. 5A-6E.

One of the advantages of the invention is that it facilitates servicing and replacing the screen separating devices with minimum decanter down time and labour demand. The rotating assembly can remain intact and in place in it's bearing pedestals during servicing. The screen section is preferably divided into two or more part-cylindrical segments which are removed individually for replacement or servicing.

The invention may be applicable to soap dish and tile-type systems described above, although it is envisaged that the main application of this invention will be its application in a wire grid-type filtration device.

Figure 5B:
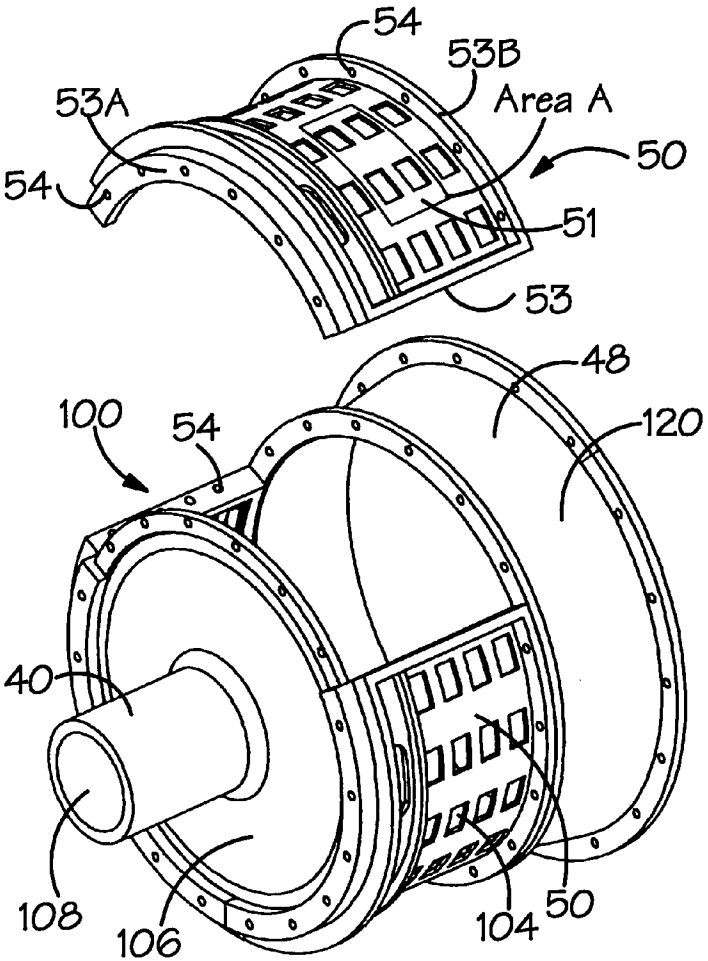
FIG. 5B is perspective view showing the screen bowl section of FIG. 5A partially disassembled.
Figure 5A:
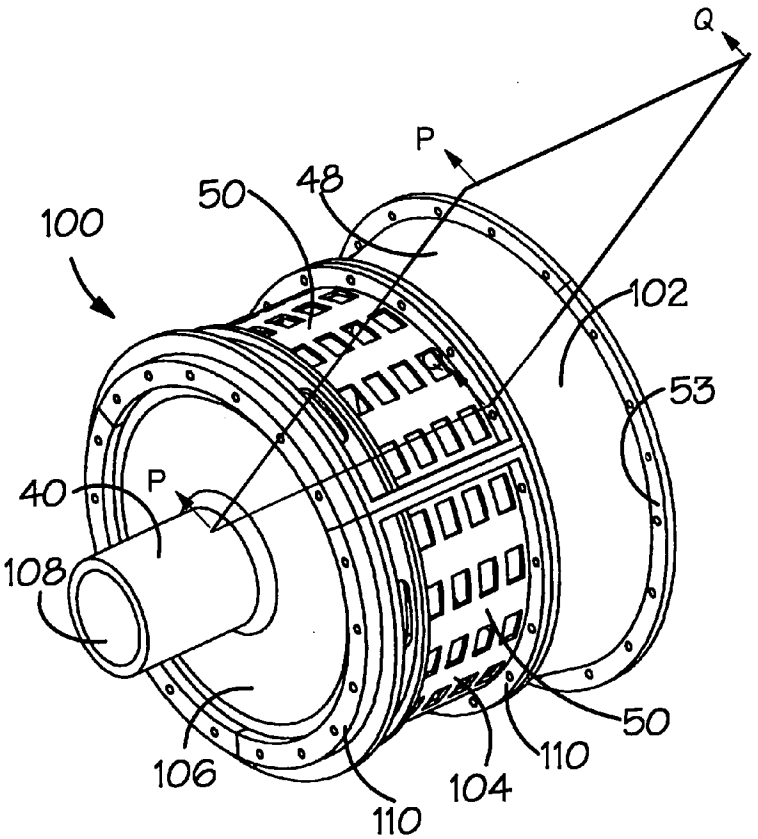
FIG. 5A is a perspective view of a first embodiment of screen bowl section according to the invention.
Figure 6B:
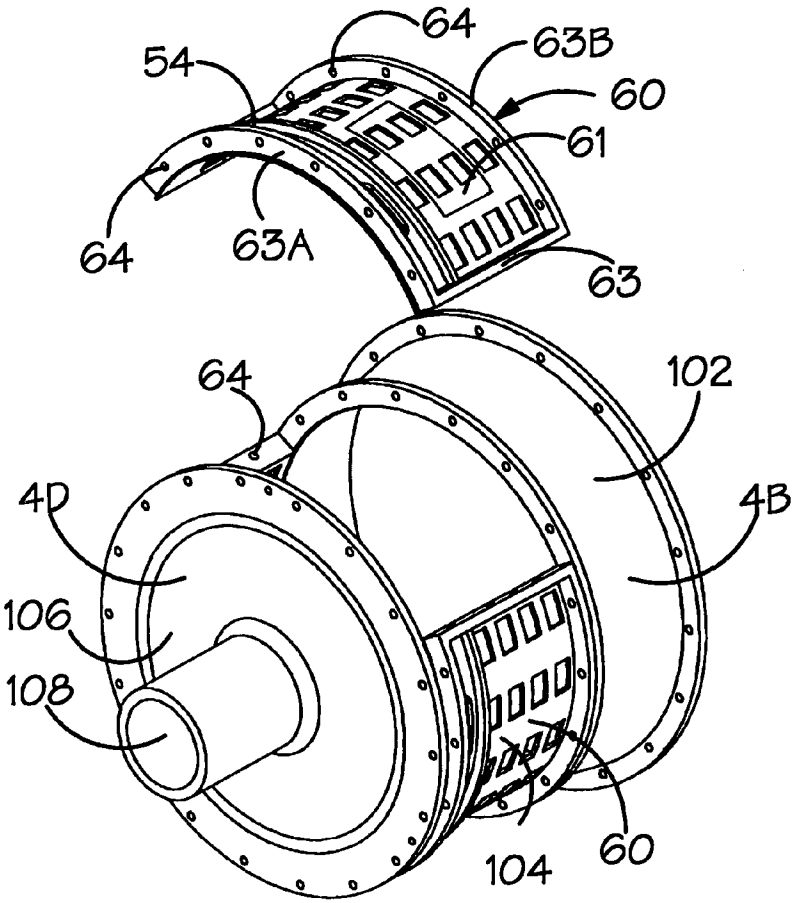
FIG. 6B is perspective view showing the screen bowl section of FIG. 6A partially disassembled.
Figure 6A:
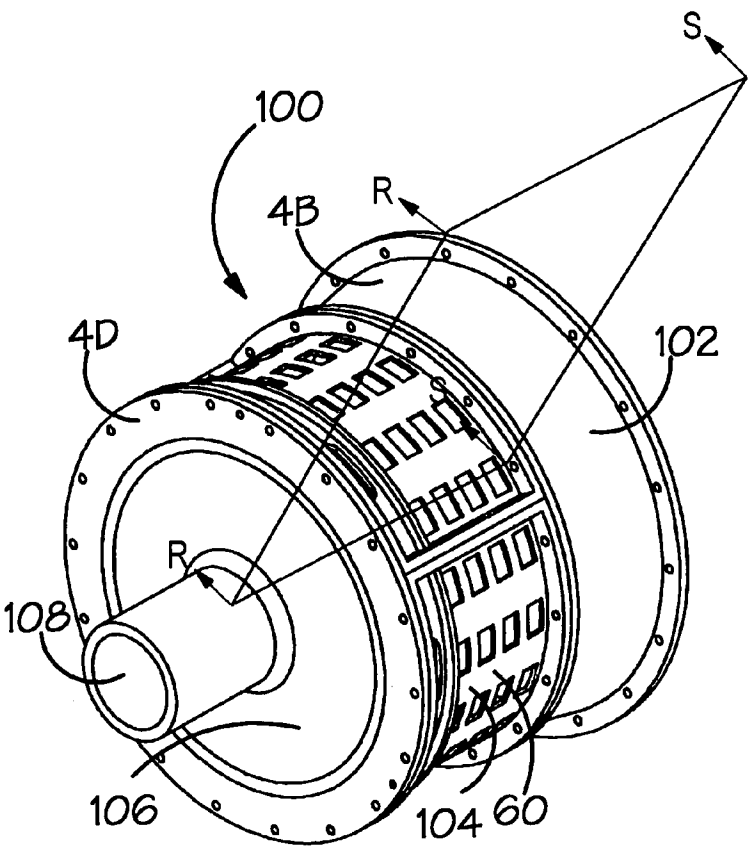
FIG. 6A is a perspective view of a second embodiment of screen bowl section according to the invention.

Aspects that are common to, or similar in, both embodiments of the invention are shown in FIGS. 5A and 6A, in which the screen bowl section 100 of a screen bowl decanting centrifuge comprises a generally frusto-conical annular support 102, a generally cylindrical, hollow screen section 104 and a generally planar, circular end wall portion 106. A hollow cylindrical axle 108 extends perpendicularly from the centre of the outer face of the circular end plate 106 which supports, and about which, the entire rotating assembly of the centrifuge rotates.

The annular support 102, screen section 104, end plate 106 are coaxial and are bolted to one another using bolts that extend through apertures 54, 64 in outwardly or inwardly projecting, radial flanges 110. The axle 108 is permanently welded to the exterior face of the end plate 106.

The screen section 104 comprises three identical part-cylindrical segments 50, 60 that are individually bolted at their axially opposite ends to the annular support 102 and end plate 106. Each segment 50, 60 can be considered to comprise an integrally formed outer support frame and a multiply-apertured side wall portion 51, 61. The outer frame is made-up of axially opposed flanges 53A, 63A and 53B, 63B that bolt to the end plate 106 and the annular support 102, respectively, and radial flanges 53, 63 having flat outer faces that abut and mate intimately with the flat outer faces of the radial flanges 53, 63 of an adjacent screen segment 50.

A removable wire grid 59, 69 is fitted inside each screen segment 50, 60 to provide one third of the total filtration area together with solids discharge ports 52, 62. Alternatively, a soap dish or tile assembly similar to that described above could be used instead of, or in addition to, a removable wire grid.

FIGS. 5B and 6B show the screen bowl sections 100 with one segment 50, 60 removed and lifted from the rotating assembly ready for servicing.

Figure 5C:
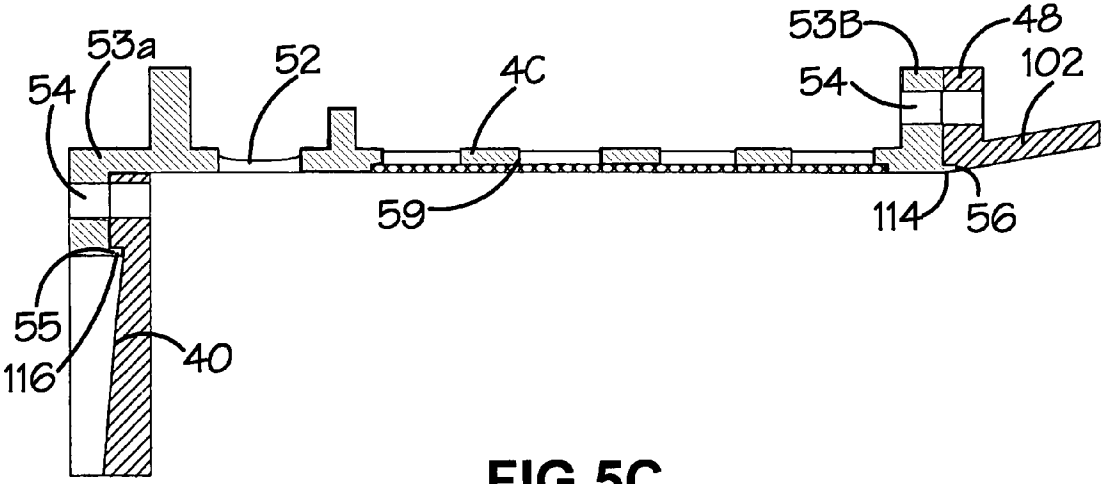
FIG. 5C is a partial cross-section of FIG. 5A on PPQQ.

Aspects that apply to the first embodiment of the invention only are shown in FIG. 5C, which is a cross-section on PPQQ of FIG. 5A. The end face of the annular support comprises a rebate 56 for receiving a circumferential lip 114 that projects axially outwardly from the end flange 54B of each screen segment 50. At the opposite end of each screen segment 50, the end flange 54 projects radially inwardly and carries at its free end, an axially inwardly projecting circumferential lip 116 that cooperates with the inner edge of an annulus 55 that projects axially outwardly from the outer face of the end plate 106. The cooperation of the rebate 56 and lip 114, and the lip 116 and the annulus 55 serves to resist radial or centrifugal forces that are generated during operation of the centrifuge.

Figure 5D:
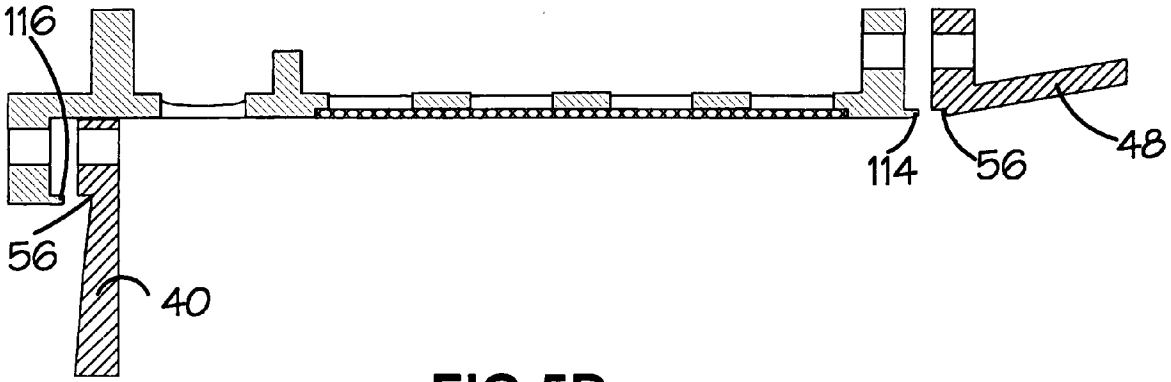
FIG. 5D is a partial cross-section similar to FIG. 5C but showing the part-tubular segment disengaged from the annular support and the end plate.

FIG. 5D shows how the screen segments 50 can be removed for servicing, replacement or repair. The bolts (not shown) connecting the screen segment 50 to the annular support 102 and end plate 106 are removed and the segment 50 axially displaced as indicated by arrows ZZ in FIG. 5D to disconnect the lips 116 and 114 from the annulus 55 and rebate 56, respectively. Once clear of the lips, the segment 50 can be removed radially for servicing, replacement or repair. However, since the other two screen segments 50 remain in position, the rotating assembly continues to be supported by the axle 106 during the servicing operation.

In addition, removal of the screen segment 50 gives clear access for the measurement of wear and the servicing of worn conveyor flights and other conveyor components (e.g. wash nozzles) within the screen section.

Once the segment 50 has been serviced, it can be re-fitted and the rotating assembly rotated through 120 degrees to permit access to, and allow removal of, the next screen segment 50.

Figure 6C:
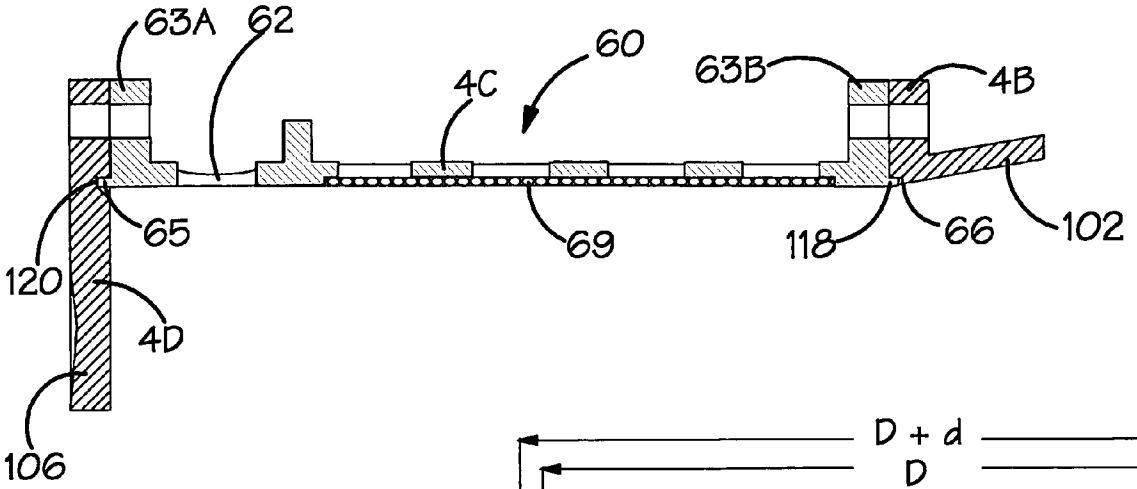
FIG. 6C is a partial cross-section of FIG. 6A on RRSS.

Aspects of that apply only to the second embodiment of the invention are shown in FIG. 6C, which is a cross-section on RRSS of FIG. 6A. The second embodiment of the screen bowl section 100 in which the end face of the annular support comprises a rebate 66 for receiving a circumferential lip 118 that projects axially outwardly from the end flange 64B of each screen segment 50.

At the opposite end of each screen segment 50, the end flange 64 projects radially outwardly. A circumferential lip 120 extends axially outwardly from the end face of the end flange 64 which lip 120 cooperates with a circumferential groove 65 machined into the inner face of the end plate 106. The cooperation of the groove 65 and lip 120, and the lip 118 and rebate 66 serves to resist radial or centrifugal forces that are generated during operation of the centrifuge.

Figure 6D:
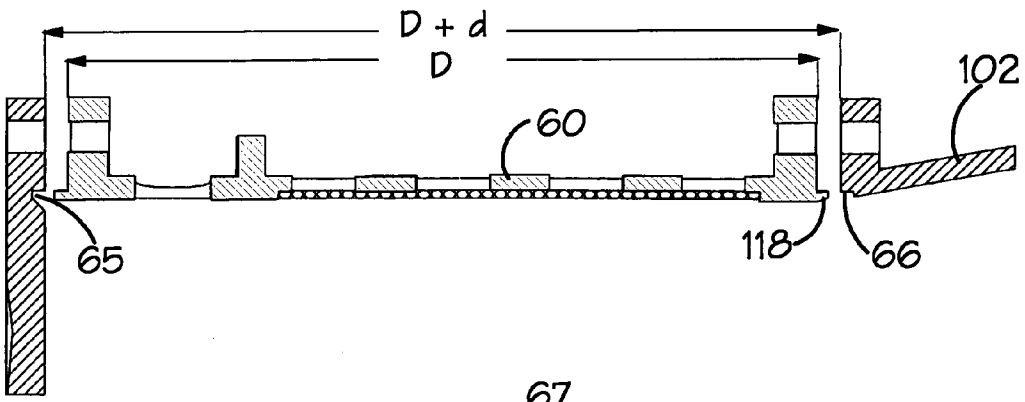
FIG. 6D is a partial cross-section similar to FIG. 6C but showing the part-tubular segment disengaged from the annular support and the end plate.
Figure 6E:
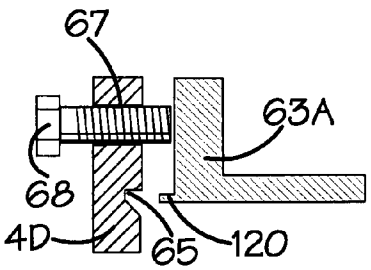
FIG. 6E is a partial cross-section similar to FIG. 6C but showing use of jacking screws through clearance holes in the end plate.

The end plate 106 has additional threaded holes 67 corresponding to each of the screen segments 60 for receiving jacking screws 68. To remove a screen segment, as shown in FIG. 6D, all retaining bolts for the segment in question are removed and the bolts retaining the other segments 60 to the end plate 106 and annular support 104 are loosened. Jacking screws 68 are then screwed into the end plate 106 and are tightened to exert an opening axial thrust between the assembled screen section and the bowl end plate as indicated in FIG. 6D. The rotating assembly bearings 1 and conveyor bearings 9 are designed to accommodate a limited amount of axial displacement. The force exerted by the jacking screws 68 increases the operational length D of the screen bowl section from D to D+d. The length increase d is sufficient for the lips 118, 120 of the screen segment 60 to clear the rebate 66 and groove 65, respectively, and to allow the screen segment 60 to be lifted radially clear of, and be removed from, the rotating assembly for replacement or servicing.

On completion of the servicing/replacement the jacking screws 68 are used through clearance holes in the bowl end plate 106 and matching tapped holes in the flanged frame 63A to apply a closing thrust to reduce d to zero and prepare the screen section for reassembly and operation.

In some applications, the rate of wear of the filter bed is uneven, typically higher at the solids discharge end of the filter bed, and it may be economic to reverse the screen segments 50, 60 for further use rather than to replace them. In the constructions described in FIGS. 5A to 5D and 6A to 6D, in each screen segment removed, the wire grid filter bed 54, 64 can be replaced or removed and axially reversed and, if necessary, the solids discharge ports 52, 62 refurbished.

The invention may provide a screen capable of supporting the rotational and other operational stresses but which is divided into segments to combine a high filtration percentage open area of between 13% and 25%, and minimum screen length for the given degree of filtration. Screen, filter bed and solids discharge port repair/replacement, can achieved at reduced process downtime and cost—all without removing the rotating assembly from the centrifuge/decanter.

Additionally or alternatively, the invention may also provide access to the conveyor within the screen section for the servicing/repair of worn flights and other conveyor components. By using a simple frame gauge mounted on the flanges/lips that support the lifted screen segment, the flight tip wear can be measured and the worn flight tips serviced locally—an advantage over the prior art soap dish-type devices in which access to the conveyor flight tips is limited to what can be accessed through the apertures in the screen section unless the entire rotating unit is disassembled and removed.

In contrast to known systems, the invention may offer the advantage of not needing to remove and disassemble the entire rotating assembly to service the screen section and associated conveyor components, which can significantly reduce cost and downtime.

The invention is not limited to the details of the foregoing embodiments. For example, the shapes, dimensions, materials etc. quoted are intended to be illustrative, rather than limiting. In particular, the invention has been described with reference to a screen bowl comprising three removable screen segments, although fewer or more, removable screen segments may be provided. In addition, alternative means for detachably affixing the screen segments to one another and/or the annular support and/or end plate may be used, for example clip fittings, temporary welded joints, adhesives etc. Additionally or alternatively, means may be provided for applying a biasing or retaining force to the components of the screen bowl, which retaining force can be removed to permit the screen bowl to be disassembled. For example, a variant of the embodiment depicted in FIGS. 6A to 6D could comprise an axial spring for maintaining the lips and recesses/grooves in engagement with one another.

The invention claimed is:

1. A screen bowl decanting centrifuge comprising a rotatable bowl and a conveyor assembly adapted, in use, to separate a slurry into solids and liquids components, and an outlet for the liquids component which outlet communicates with the inlet of a perforated bowl section arranged, in use, to filter the liquids component as it passes through the perforations of a screen or screens, wherein the perforated bowl section is hollow and comprises a plurality of assembled screen support segments, each of which comprises a removably mounted side wall portion having multiple apertures.

2. The screen bowl decanting centrifuge as claimed in claim 1, wherein the inlet of the perforated bowl section comprises an annular support to which each of the screen support segments is removably mounted.

3. The screen bowl decanting centrifuge as claimed in claim 1, wherein the perforated bowl section comprises an end plate to which each of the screen support segments is removably mountable.

4. The screen bowl decanting centrifuge as claimed in claim 1, wherein each screen support segment is part-tubular.

5. The screen bowl decanting centrifuge as claimed in claim 4, wherein the inlet of the perforated bowl section comprises an annular support to which each of the screen support segments is removably mountable, wherein each screen support segment is part-tubular and wherein the part tubular segments are individually and/or detachably affixed to, and between, the annular support and the end plate.

6. The screen bowl decanting centrifuge as claimed in claim 5, wherein the or each part-tubular segment, the annular support and/or the end plate comprises a flange.

7. The screen bowl decanting centrifuge as claimed in claim 6, wherein the or each part-tubular segment is individually and/or detachably affixed to, and between, the annular support and the end plate using screws.

8. The screen bowl decanting centrifuge as claimed in any of claim 4, wherein the or each part-tubular segment comprises a lip or groove adapted, in use, to engage a groove or lip of the annular support or the end plate.

9. The screen bowl decanting centrifuge as claimed in claim 2, wherein the distance between the annular support and the end plate is adjustable.

10. The screen bowl decanting centrifuge as claimed in claim 9, further comprising a jacking screw arranged to cooperate with the part-tubular segment and the annular support ring or the end plate for adjusting the spacing between the annular support and the end plate.

11. The screen bowl decanting centrifuge as claimed in claim 10, wherein the or each part-tubular segment comprises a lip or groove adapted, in use, to engage a groove or lip of the annular support or the end plate and wherein the jacking screw is adapted to enable the spacing between the annular support and the end plate to be increased to an extent whereby the lip disengages from the recess.

12. The screen bowl decanting centrifuge as claimed in claim 1, wherein the or each part-tubular segment comprises a through aperture or a plurality of through-apertures.

13. The screen bowl decanting centrifuge as claimed in claim 12, further comprising a perforated liner overlying the or each through aperture.

14. The screen bowl decanting centrifuge as claimed in claim 13, wherein the liner is located within the perforated side wall.

15. The screen bowl decanting centrifuge as claimed in claim 13, wherein the liner comprises any one or more of the group comprising a wire grid, a soap dish and tile.

* * * * *